United States Patent [19]

Walter

[11] 4,049,065

[45] Sept. 20, 1977

[54] DRILLING APPARATUS

[76] Inventor: Hans-Philipp Walter, 22 Oderstrasse, D-3570 Stadt Allendorf 1, Germany

[21] Appl. No.: 596,551

[22] Filed: July 16, 1975

[30] Foreign Application Priority Data

July 24, 1974 Germany ..... 2435535

[51] Int. Cl.[2] ..... E21B 19/14

[52] U.S. Cl. ..... 175/52; 175/85; 173/23; 173/44; 173/164

[58] Field of Search ..... 175/52, 85, 53; 173/164, 23, 43; 214/2.5; 211/60 S; 166/315

[56] References Cited

U.S. PATENT DOCUMENTS

| | | | |
|---|---|---|---|
| 2,255,241 | 9/1941 | Brown | 173/43 X |
| 2,596,670 | 5/1952 | Francis et al. | 175/209 |
| 2,849,212 | 8/1958 | Robbins | 175/85 X |
| 3,181,630 | 5/1965 | Coburn | 175/85 |
| 3,333,646 | 8/1967 | Hoen et al. | 173/43 X |
| 3,395,766 | 8/1968 | Granville | 173/43 X |
| 3,493,061 | 2/1970 | Gyongyosi | 175/52 |
| 3,684,039 | 8/1972 | Coyne | 175/52 X |
| 3,741,322 | 6/1973 | Wolters | 175/52 |
| 3,766,995 | 10/1973 | Young et al. | 175/53 |

*Primary Examiner*—Ernest R. Purser
*Assistant Examiner*—Richard E. Favreau
*Attorney, Agent, or Firm*—Fred Philpitt

[57] ABSTRACT

A wheeled or crawler-type vehicle carries a support structure for a drilling apparatus such as used in rock drilling. The support structure includes a tower enclosing a rotary rack for drill rods which may be screwed together by cone threads to form a drill string. The tower is attached to a subtower that can be swivelled relative to the support structure for drilling in any desired angular position. Various devices greatly facilitate the storing and handling of each topmost drill rod. There are transverse drives as well as centering, gripping and retaining means, preferably operated by fluid cylinders, for moving the rotary rack and for transferring the respective drill rod from or to nesting seats in the rotary rack that can be revolved stepwise into accurate juxtaposition with a transfer aperture at the drilling center in line with the drilling head. The latter may be provided with an auxiliary motor to increase the effective torque for heavy duty, e.g. for breaking the screwed connection of the topmost drill rod to the drill string which operation may be assisted by a double spindle system in the drilling head owing to positively locking matched profiles at the drill rod end. Similar matched profiles in the other implements aid in the transfer operations as well.

13 Claims, 28 Drawing Figures

DRILLING APPARATUS

FIELD OF THE INVENTION

Figure 2:
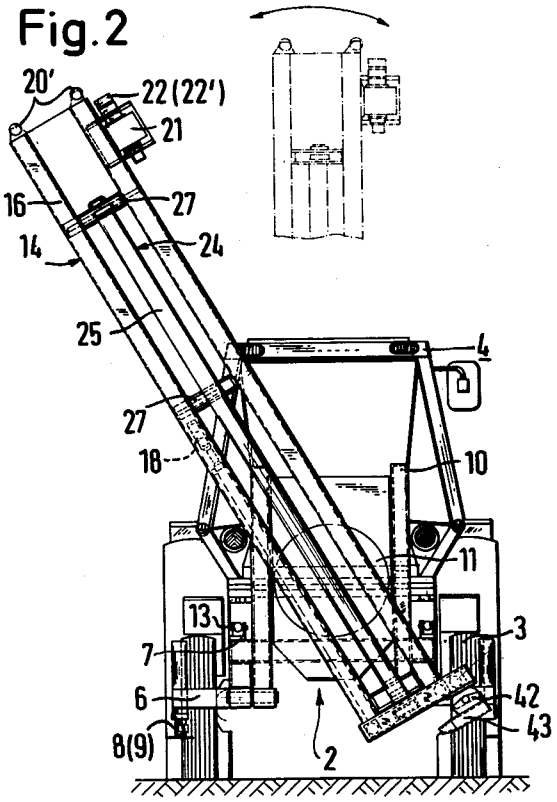

The invention relates to drilling apparatus and more particularly to a mobile-base drill support structure designed for storing and handling a plurality of drill rods.

PRIOR ART

Conventional mobile drilling apparatus such as used in rock drilling frequently have a heavy tower which, for transportation, may be tilted around an axis transverse to the direction of motion of the mobile base, e.g. a crawler type vehicle. Numerous forms of devices have been provided for storing a plurality of drill rods in operative relation to the tower of the apparatus drilling a hole. Thus there are drill rod storage and handling arrangements employing a rack which stores the drill steels out of alignment with the drill hole and which has to be swung over it for transferring every single drill rod between the rack and the drilling head. However, the movement of the entire rack and all of its carried rods over the drill hole is undesirable in that it requires extensive, complex mechanisms involving a plurality of hydraulic and pneumatic devices, motors, and the like for indexing and aligning the drill rods with the drilling head.

In one type of mobile drilling apparatus, a rotary rack is provided that can hold only four drilling rods and may be swivelled to the center of the tower for storage and removal of a drill rod. An associated retainer comprising security, gripping and locking means, is relatively complicated and expensive. Due to the heavy load of the full rack, the latter is instable and easily deformed; above all, angle hole drilling may result in strong torsional strain on the rack and/or its retainer. The drill rods are secured by means of holding pots or cups on a bear-up table out of which every single rod must be lifted for removal and into which it must be inserted for storage, respectively.

Similar apparatus has, at the front part of the drill support structure, a tower with a rack that may be rotated, using a chain drive and a pivotable transfer device which comprises extensible and pivotable parts as well as particular actuating and locking means. Consequently, this conventional design is also objectionable because of its rather complex structure requiring expensive manufacture and assembly. Moreover, the construction is both heavy and susceptible to trouble. Another serious disadvantage is that the drilling position is restricted in advance by the positions of the tower and the drilling head which can merely be moved up and down, so that lateral displacements and shifts are impossible although in practice, e.g in the beginning of drilling a hole or in anchor drilling, it is often desirable to realign the equipment during operation.

Another type of conventional drilling apparatus uses a carriage serving as a derrick or tower that can be inclined around a horizontal axis transverse to which a bearing support for the carriage may be pivoted. The drill rod rack extending laterally projects relatively far so that there is a large off-center load. In addition, this design is also very heavy.

OBJECTS OF THE INVENTION

It is an important object of the invention to overcome the disadvantages of the prior art and to provide, with simple and economical means, improved drilling apparatus, especially of medium size.

It is another object of the invention to provide drilling apparatus of stable, versatile design despite its relatively light weight.

Still another object of the invention consists in providing drilling apparatus that can be easily managed by a single operator even under rough conditions.

A further object of the invention is the provision of drilling apparatus requiring a reduced energy supply, yet performing at least as well as big conventional drilling units.

SUMMARY OF THE INVENTION

A drilling apparatus according to the invention comprises a mobile-base support structure for a drilling tower that is tiltable around a horizontal axis and carries an up-and-down movable drilling head including a rotary drill rod drive, said drill rods having cone thread ends in order to permit the formation of a drill string, being borne inside a storage rack by a supporting table and being secured by retainer means, said drill rod rack receiving said drill rods in a parallel arrangement of rotational symmetry and cooperating with gripping, screwing and unscrewing means for handling said drill rods in order to remove same from said rack or insert same therein, said tower enclosing said rack and being mounted on a bearing means so as to allow adjustment in a transverse relation to the horizontal tilting axis.

The drilling apparatus of the invention is not only of simple and sturdy design, but also provided with a relatively light weight tower that warrants strong support irrespective of the drilling position. Since the tower is attached to a bearing which permits adjustment transversely to the tiliting axis, e.g. by use of collar-type swivel ring, it is easily possible to perform drilling in any angular position, for example horizontally or vertically or at a small inclination angle. Although manufacture of the apparatus is economical, the design is rugged and its operation reliable even under severe conditions. A particular advantage results from the close package of the drill rods inside the rack which is in turn enclosed by the tower. Thus the drilling apparatus according to the invention is most versatile and particularly suited for big-bore holdes and deep well drilling with the aid of pneumatically operated hammer drills. Other applications include hydraulically operated external hammers, core drilling apparatus having a mounted hoist, etc.

The drilling position can quickly be established by means of an embodiment of the invention providing a pivotable subtower which is attached to the mobile-base support structure and which supports the bearing for the rack tower such that the latter can be adjusted in a vertical direction. Using hydraulic cylinders and lower pivots therefor, this subtower can rapidly assume virtually any angular position relative to the ground. In combination with the full-circle swivel bearing, there is for instance no difficulty in operating the tower parallel to the ground and more particularly in a horizontal plane. Besides, the subtower permits of an additional upward extension that is quite important in some cases.

Another embodiment of the invention provides a framework-type tower having flat sides one of which may be secured approximately to the center of the bearing that may in turn be attached about in the center of the support structure fore-part so as to achieve a highly desirable load distribution and symmetric stress bear-up, in particular if the framework is slightly displaced towards one side of said support structure while the other side of the framework carries the drilling head slide track. Consequently, the center of gravity of the equipment is substantially in the center thereof, at least during operation of the apparatus.

At the foot of the tower, there may be arranged a drill rod centering device that holds the drill string closely above the drill hole in order to safeguard the exact drill position and to prevent out-of-true drilling. Preferably, there is below the centering device a jointed ground shoe with a fitting for a fluid device so that not only is the tower firmly planted on the ground, but also dust and drillings may be economically evacuated either by air or by flushing without harm to the environment.

The tower is further stabilized by downwardly extensible stanchions having universal joint shoes for propping up the support structure at least at the fore-part thereof, preferably near the bearing and/or the subtower. Additional stanchions may be provided e.g. at the mobile base corners.

Particularly important is an embodiment of the invention featuring a drill rod rack that may be situated in the drill center or be at least partly movable thither. As a result, comparatively little energy and time is consumed for transferring a new drill rod from the rack into the drill position, or vice-versa when the drill string is to be shortened. The invention contemplates above all a revolver-type magazine including a supporting table and at least one clamping or ring retainer that is provided with peripheral recesses and/or grappling jaws for the various drill rods. An aperture at side of the drilling head permits easy removal or nesting of each drill rod by means of a transverse drive such as a fluid cylinder as soon as the respective rod has been moved into exact juxtaposition to the aperture. For effecting such an indexing motion, there is preferably a unidirectional stepper motor with associated locking means, e.g. a ratchet and pawl arrangement. It will be realized that the revolver rack inside the tower provides optimum packing and load distribution under all conditions. In addition, the various drill rods can be picked up or stored in any sequence, whereas in prior art drilling apparatus, only every second rod or the foremost one could be removed and loaded, respectively.

Assembling and dismantling the drill string is much accelerated by means of a breaking device for the cone thread and by a retaining device for a drill rod situated in the drill center. Such retaining and thread breaking or unscrewing devices may be arranged at either end of the tower or at its foot only, and they may be provided with projections for locking in matching recesses of the outer or upper drill rod ends. Similarly, grappler means at the drilling head may be provided with an inside profile adapted to positively lock a matching outer profile of the outer or upper drill rod ends. Such locking facilitates the transfer of the individual drill rods especially if, according to another embodiment of the invention, the drilling head retaining device is actuated by a transverse drive such as a fluid cylinder which is associated to the aperture of the retaining device and/or to the grappler that may have spreader arms engaged by the piston of the drive cylinder.

Further in accordance with the invention, the supporting, centering, retaining and/or securing means for a drill rod situated in the drilling center may be provided with jaws having an inside profile adapted to positively lock in a circumferential groove at the outer or upper end of each drill rod wherein the outer profile of a fluid-actuated hammer drill may also be locked for secure connection. This feature greatly aids in carrying or suspending the drill rod or drill string weight during the various handling operations.

Unscrewing the top drill rod from the drill string is often tedious and sometimes a serious problem with conventional apparatus. According to another feature of the invention, there is at the drilling head an outer drill spindle designed to match the drill rod profile and enclosing a coaxially movable spindle proper with a cone thread at its lower end. By retaining the upper drill rod end within the profiled inset and holding it under the force of the drilling head, which may be assisted by an auxiliary drill rod drive, even a very tightly jammed rod connection can be unscrewed practically in a jiffy by withdrawing the outer drill spindle and firmly gripping the lower drill rod end in the thread breaking device. Furthermore, the spindle proper may be hollow and have at its upper end a fitting for attaching a flushing means thereto so that a flushing medium may be introduced conveniently.

BRIEF FIGURE DESCRIPTION

Further objects, features and advantages of the invention appear from the following detailed description given below, taken in connection with the accompanying drawings which form a part of this specification and which illustrate, by way of example, preferred embodiments of the invention.

Figure 1:
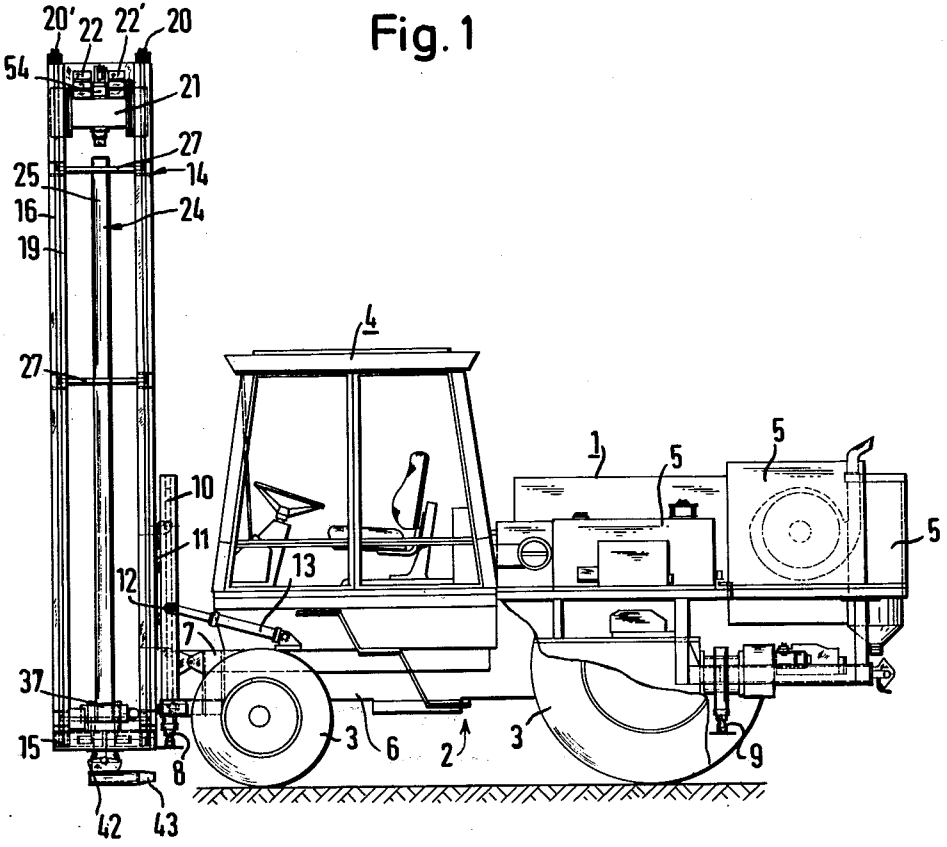
Figure 4:
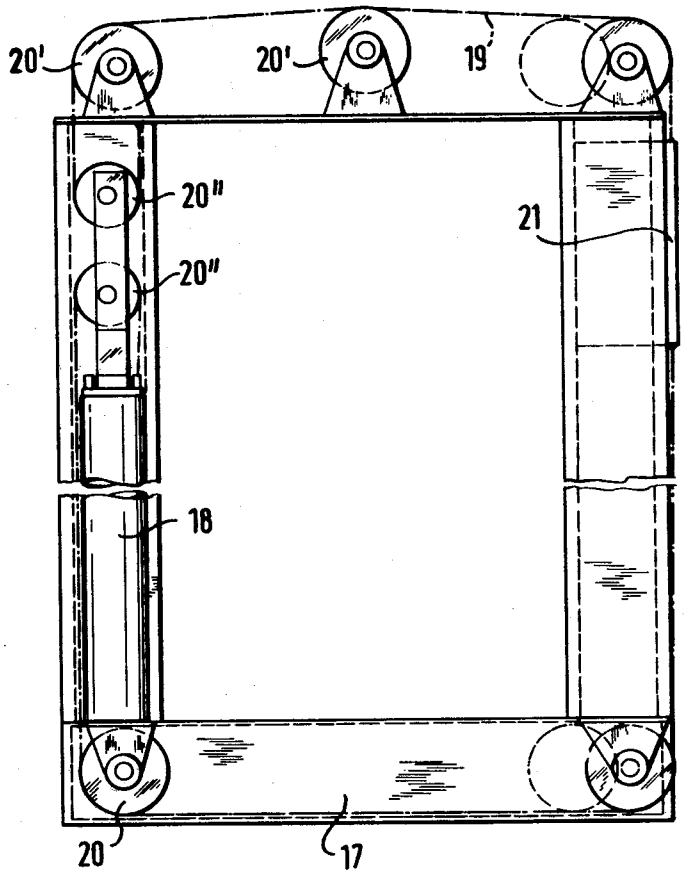
Figure 3:
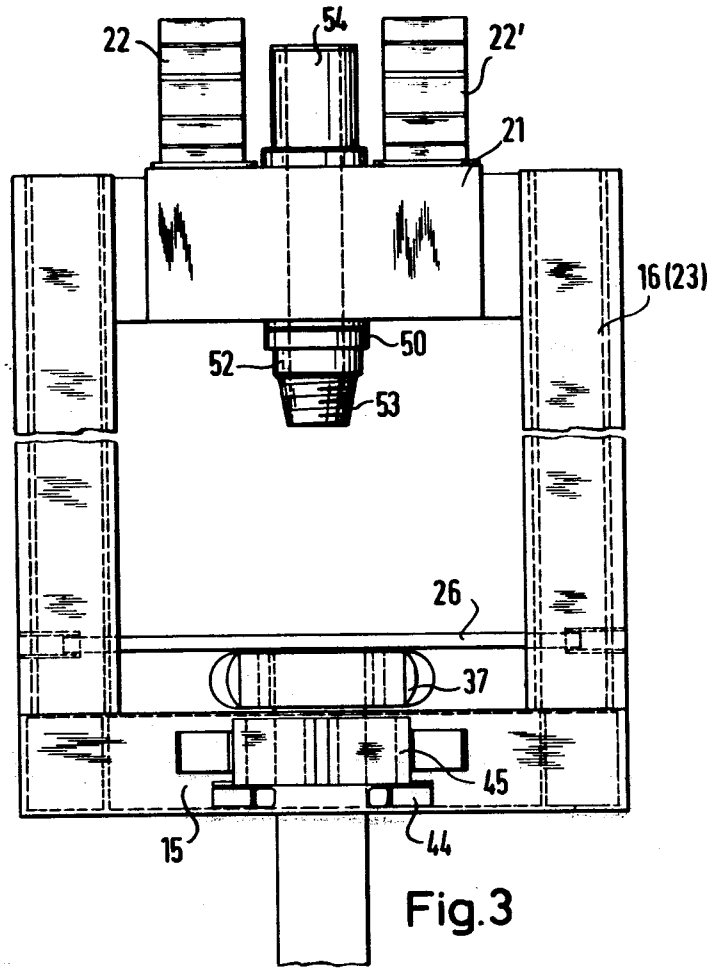
Figure 6:
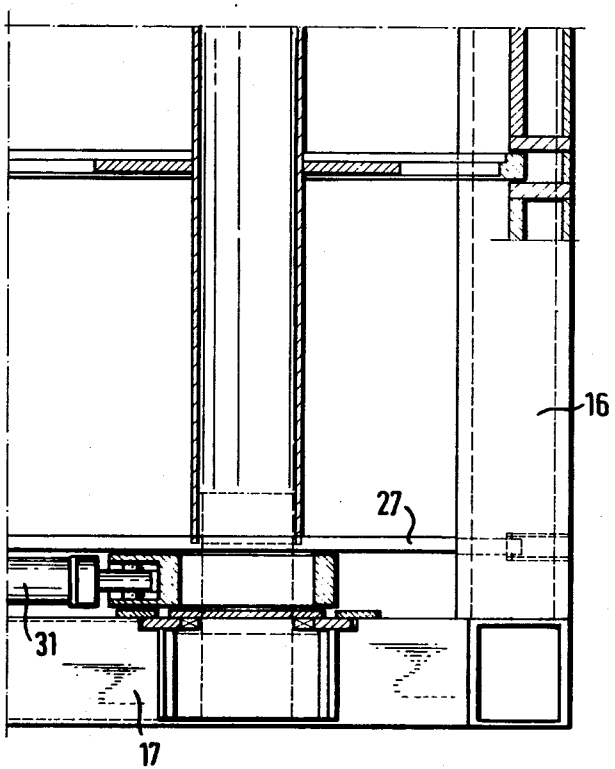
Figure 5:
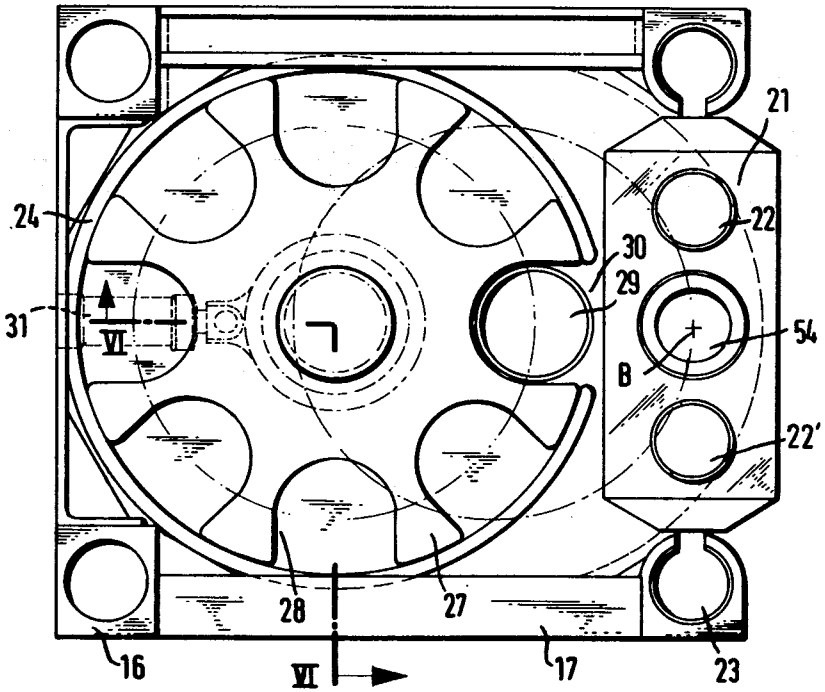
Figure 7:
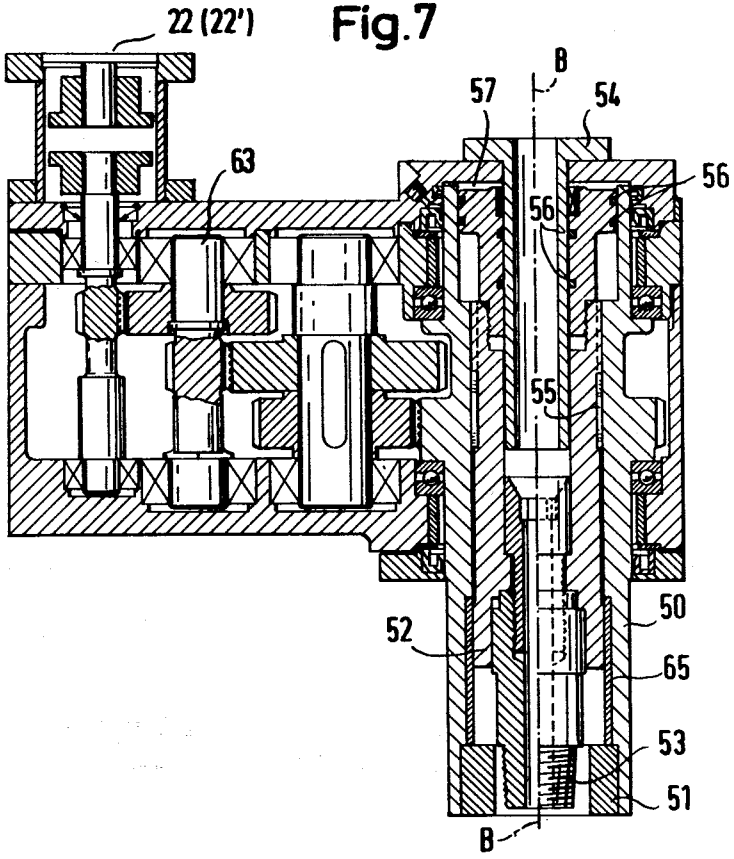
Figure 9:
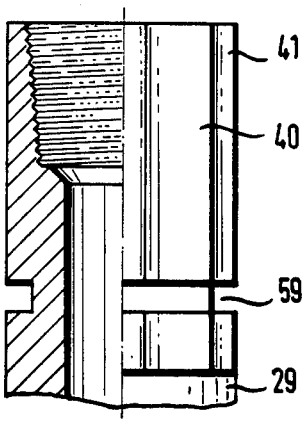
Figure 8:
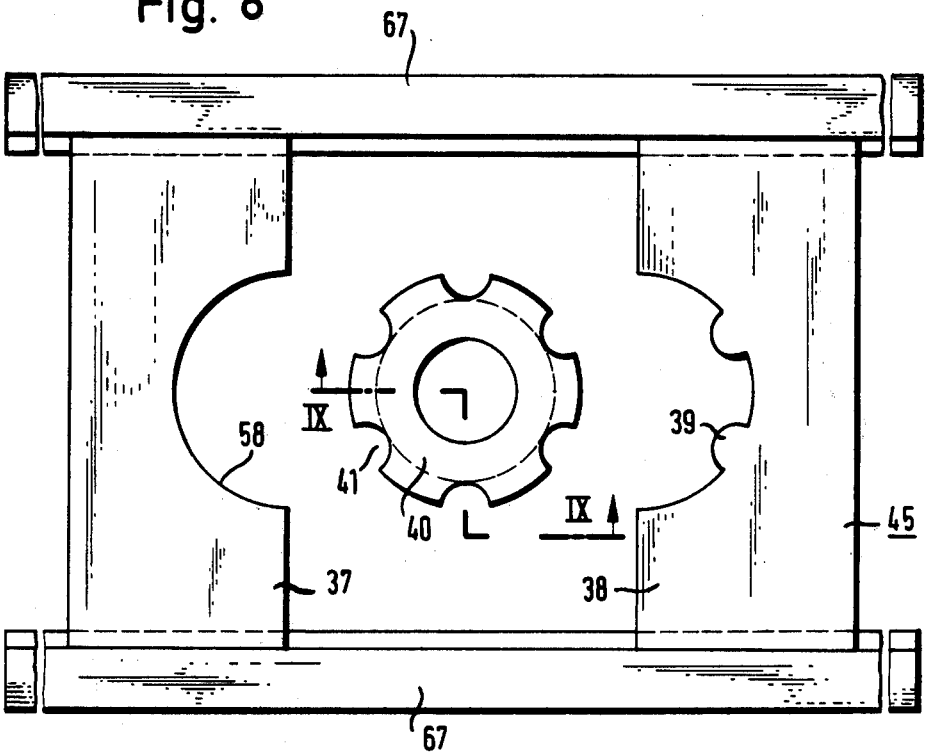

In the drawings:

FIG. 1 is a side elevation of a mobile base drilling apparatus,

FIG. 2 is a front view of the apparatus shown in FIG. 1 with an inclined tower, FIG. 3 and FIG. 4 show skeleton side elevations of a tower, FIG. 5 is a top view of a tower having a revolver rack and a slidable drilling head, FIG. 6 is a sectional view taken along lines VI—VI in FIG. 5, FIG. 7 is a longitudinal section through a drilling head drive, FIG. 8 is a simplified top view of one part each of a centering device and of a retaining support with a drill rod end therebetween, FIG. 9 is a sectional view taken along lines IX—IX in FIG. 8, FIGS. 10*a*, 10*b* and 10*c* are sectional views showing various positions of grapples.

Figure 19:
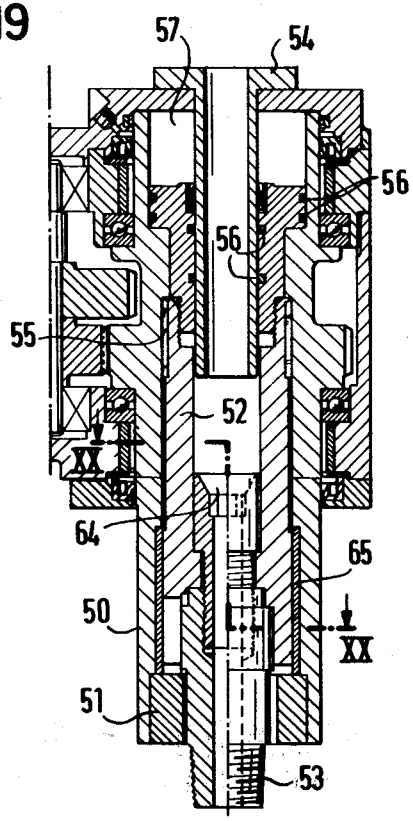
Figure 20:
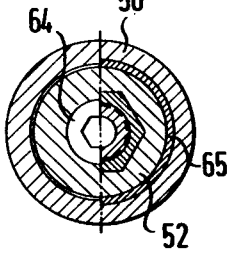
Figure 12:
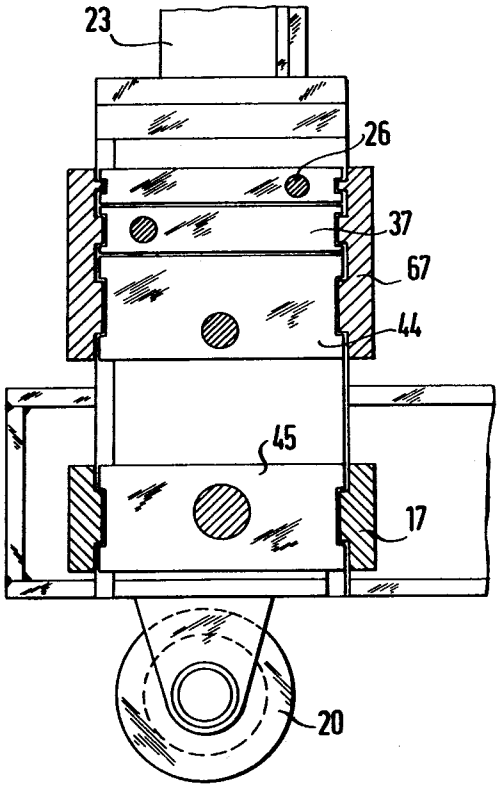
Figure 11:
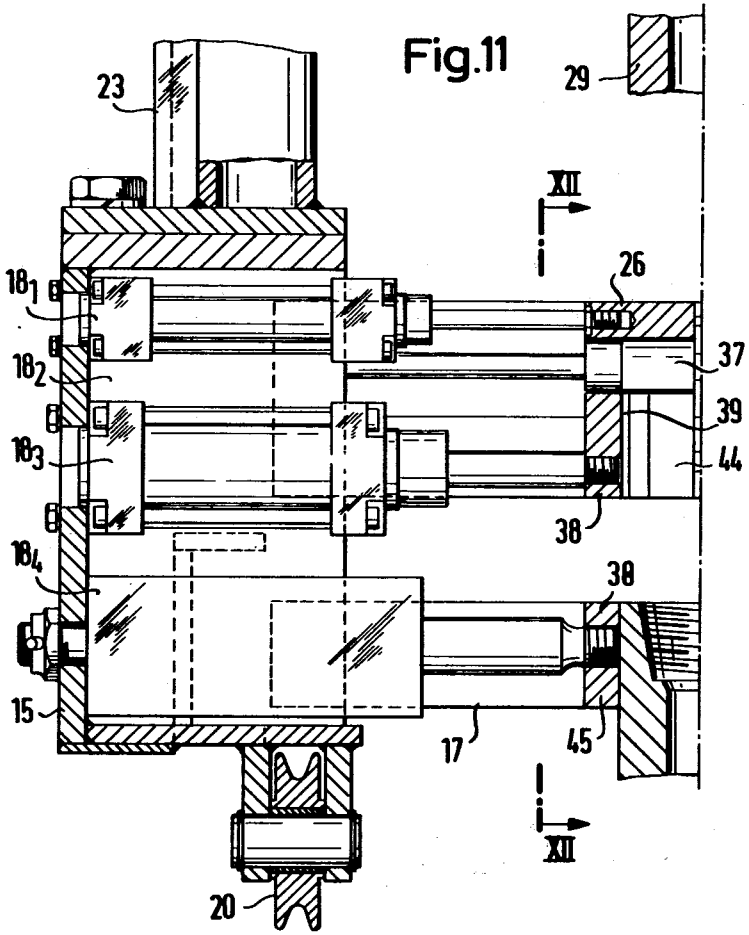
Figure 13:
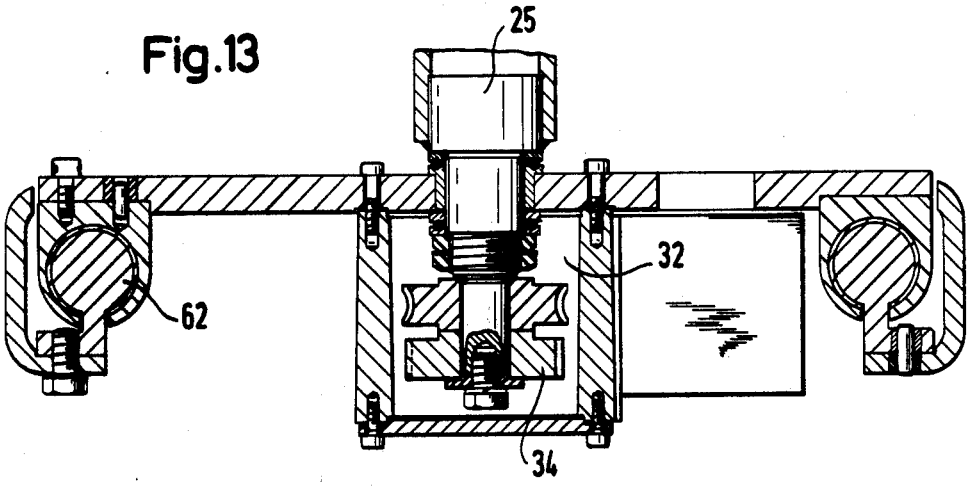
Figure 14:
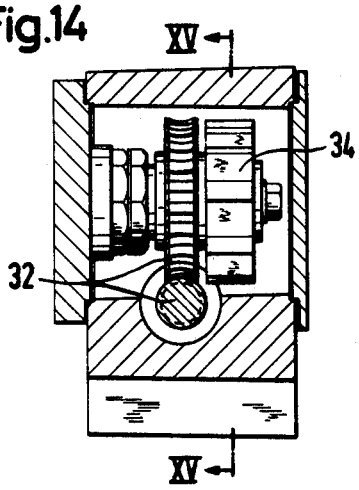
Figure 15:
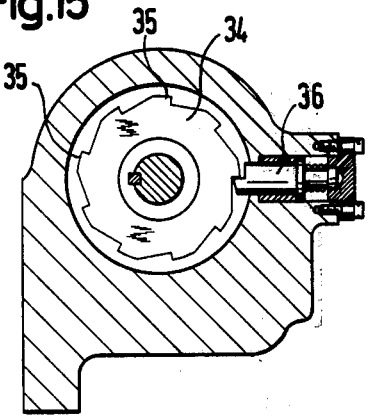

FIG. 11 is a simplified sectional view showing fluid cylinder drives for various gripping and retaining means, FIG. 12 is a sectional view taken along lines XII—XII in FIG. 11, FIG. 13 is a sectional view of a revolver rack stepper, FIG. 14 is a partly sectional side view of the stepper drive of FIG. 13, FIG. 15 is a sectional view taken along lines XV—XV in FIG. 14, FIG. 16, FIG. 17, and FIG. 18 each show simplified front views (*a*), side views (*b*), and top views (*c*) of various operational phases of a revolver rack enclosed in a tower, FIG. 19 is a sectional view similar to FIG. 7 in a different working position, and FIG. 20 is a sectional view taken along lines XX—XX in FIG. 19.

DETAILED SPECIFICATION

The drilling apparatus 1 shown in FIGS. 1 and 2 comprises a supporting structure 2 with a mobile base 3 that may have an all-wheel drive or be of the crawler type. For single-operator control, a cabin 4 is provided which may be replaced or complemented by a control board (not shown) to be used on a hinged bracket (not shown) outside the cabin 4, too. A built-in Diesel engine provides the automotive power. In addition, there are supply facilities 5 comprising pumps, compressors, fluid containers, conduits, lubricators, etc. The supporting structure 2 has a frame 6 whose forepart 7 is provided with stanchions 8. At the rear section there are further stanchions 9. Preferably, the stanchions 8, 9 are hydraulic cylinders with universal joints so as to relieve the weight on the axles even when the ground is pitted.

At the fore-part 7 of frame 6, there is a subtower 10 supporting a swivel bearing 11. The subtower 10 is articulated at the lower end of frame 6, and approximately at its longitudinal center there is a swivelling axis 12 for connection to fluid cylinders 13 which act to tilt the subtower 10 relative to frame 6 the fore-part 7 of which supports the swivelling join therefore (FIG. 1).

On its other side, the bearing 11 carries a twoer 14 which may be designed as a framework enclosing a rack or magazine 24 for storing drilling rods. In the embodiment shown in FIGS. 4 and 5, the tower 14 has a base frame 15 with guiding pillars 16 extending vertically thereto and with cross pieces 17, retainers 27 and a slide track 23 for a drilling head 21 which can be moved up and down along one side of the tower frame work. It is to be noted that in the drilling apparatus 1 according to the invention, the drilling head 21 will not normally constitute a front burden whereas in conventional apparatus, drilling machines have been used whose power head jutted out to the front of the tower resulting in an undesirable load and stress distribution.

It will be seen from FIGS. 1, 2 and 5 that the tower 14 of a drilling apparatus 1 is generally square or rectangular so that any one of three tower sides may be mounted to the bearing 11 at the fore-part 7 of the supporting structure 2. In particular, FIG. 2 shows an embodiment having the tower 14 approximately at the center of the fore-part 7 in such arrangement that the drilling head 21 which is mounted at an outer side of the framework faces laterally in respect of the mobile base 3 so that the drill center B is but a little offset from the longitudinal center of the vehicle whereas the center of gravity of the tower 14 is practically in dead center at least during operation. This warrants optimum distribution of load since neither the power head nor the drilling rod rack 24 projects to the front of the tower 14. For further stabilization, the tower 14 may be planted on the ground by means of a jointed ground shoe 42 to which a suction device 43 can be fitted (FIGS. 1 and 2).

The drilling head 21 is slidably guided in the slide track 23 having a suitable profile (FIG. 5). Fluid cylinders 18 (FIGS. 3 and 4) act on a rope 19 that is connected via guide pulleys 20, 20', 20'' to the sliding block of drilling head 21. Two motors 22, 22' which are provided with a gear shaft 63 (FIG. 7) serve as rotary drives for a drill string made up of drill rods 29 which are stored in the rack 24 prior to and after use.

At least at the upper end of rack 24 and, if required, about half-way between its ends, there are according to the embodiment of FIGS. 1 to 5 retainers 27 with nesting seats 28 designed for single transfer of drill rods 29 through an aperture 30 to the drilling head 21. There may be a number of nesting seats 28, e.g. eight in the example of FIG. 5 or more, enclosing a central supporting drill rod 25 within the rack 24 which rack may be moved in its entirety by means of a transverse drive to the drill center B. In another embodiment, the rack 24 having a supporting drill rod 25 and a supporting table 26 (shown in FIGS. 3, 11 and 12) is provided with grapplers 46 operated by a transverse cylinder 48 for single transfer of up to nine stored drill rods 29 without shifting the rack 24 which, therefore, principally remains in its position within the tower 14.

For revolving the rack 24, there may be a worm drive 32 together with a stepper 33 safeguarding that for transfer of a drill rod 29, there will always be a nesting seat 28 and/or a grappler 46 in exact juxtaposition to the aperture 30. As will be seen from FIGS. 13 to 15, the worm drive 32 may be direct-coupled to the stepper 33 having a ratchet wheel 34 with unidirectional teeth 35 for slipping under a spring-borne pawl 36 in one sense of rotation and for preventing rotation of the ratchet 34 in the opposite direction. As soon as the pawl 36 engages one of the teeth 35, there is always an exact transfer position of the retainer 27 relative to the aperture 30 (FIGS. 5 and 10).

Further it will be seen from FIG. 13 that for shifting the drill rod rack 24, there is provided a rack slide block 62 whose structural and power design is largely similar to the slide track arrangement 23 for the drilling head 21.

Figure 10C:
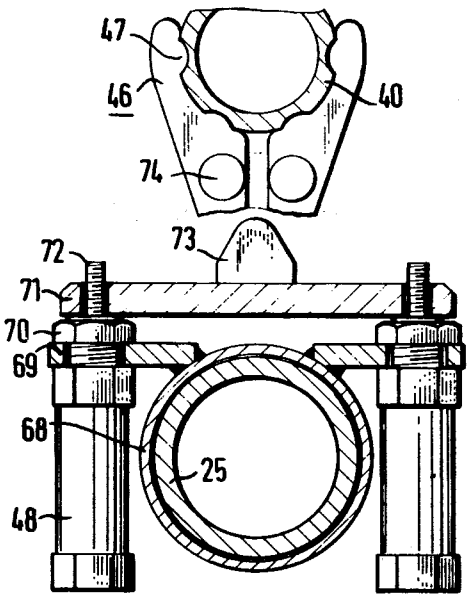
Figure 10B:
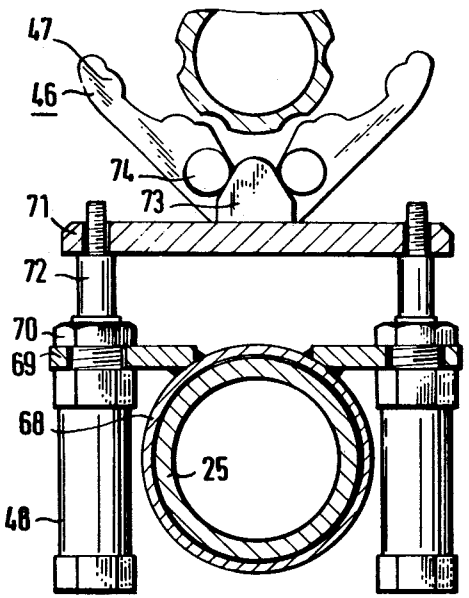
Figure 10A:
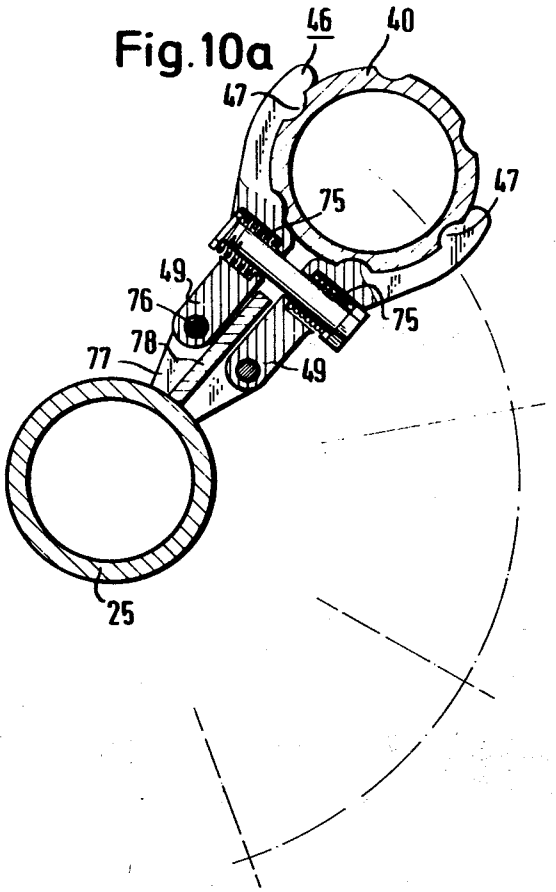

At the foot of the tower 14 is a centering block 37 (FIG. 3) having clamping jaws 38 (FIG. 8 left). There may be similar clamping jaws 38 for application to unscrewing brackets 44, an inside profile 39 having lugs, ribs or the like being provided that matches with a counter-profile 41 by way of grooves or the like at the outer ends 40 of the drill rods 29 (FIG. 8 right). This matching profile 41 of the upper ends 40 of drill rods 29 may also be used in connection with retaining devices 45 such as shown in FIGS. 10*a*, 10*b* and 10*c*, respectively. It will be seen in FIG. 10*a* that each of a number of retaining devices 45 is provided with grapplers 46 having inside profile lugs 47 as well as spreader arms 49. The supporting drill rod 25 carries plate supports 77 spaced by a stay or buffer 78 and provided with pivots 76 to which the spreader arms 49 are articulated. Compression springs 75 housed in the spreader arms 49 serve to load them towards their closed position shown in FIG. 10*a*. Thus the lugs 47 will engage the grooves 41 of upper end 40 of a drill rod 29.

FIG. 10*b* discloses how the opened position of retaining device 45 is obtained. Supporting drill rod 25 holds a pillar 68 that carries a plate 69 for mounting transverse cylinders 48 by means of nuts 70. The piston rods 72 of the transverse cylinders 48 are attached to a crosshead 71 to which a nose 73 is fixed. When the transverse cylinders 48 are operated to push crosshead 71 outwardly, nose 73 engages two stop bolts 74 mounted on one of the spreader arms 49 each. Consequently these are opened to release upper end 40 of drill rod 29. By retracting piston rods 72 and thus cross-head 71, nose 73 disengages from stop bolts 74 so that spreader arms 49 close under the force of compression springs 75 as shown in FIG. 10*c*.

In the embodiment of FIGS. 8 and 9, the retaining or holding device 45 is provided with section brackets 58 which may engage a circumferential groove 59 at the outer ends 40 of the drill rods 29 so as to support and hold these. A similar arrangement is used for retaining the drill rods 29 in the rack 24 with grippers 61 having clasp jaws 60 for engaging the circumferential groove 59 of the outer drill rod ends 40.

FIG. 11 shows the arrangement of various fluid drives $18_1$ to $18_4$ which may be hydraulic cylinders for individually operating a table rest 26, the centering block 37, the unscrewing brackets 44 and/or the supporting or retaining device 45. A sectional view of these reciprocating elements and of suitable guiding means is shown in FIG. 12.

An embodiment of the drilling head 21 is depicted in FIGS. 7 and 19. Motor 22 is arranged to drive, via gear 63, an outer drill spindle 50 that is axially fixed and that carries at its lower end a profiled inset 51 adapted to the inside profile of the ribs 39 of the unscrewing brackets 44 and thus also fits the counter-profile 41 of the outer drill rod ends 40. By means of keying 55, the outer drill spindle 50 is connected to a hollow spindle proper 52 for rotation therewith, although permitting axial movement. The spindle proper 52 has at its lower end a cone thread 53 and at its upper end a fixed flushing tube fitting 54. Seal rings 56 are provided for free pressure-sealed rotation and axial movement of the spindle proper 52 from the retracted position shown in FIG. 7 as soon as the fluid pressure in a pressure chamber 57 causes the spindle proper 52 to extend its cone thread 53 into the position shown in FIG. 19. These spindle means greatly facilitate unscrewing the drill string by breaking the cone thread of the topmost drill rod 29. In operation, the outer drill spindle 50 retains the upper drill rod end 40 in the profiled inset 51 for rotation therewith, while the spindle proper 52 is retracted. By retaining the next drill rod below in a grappler or retaining device 45, the unscrewing brackets 44 can be used to break the lower cone thread of the upper drill rod 29 to be removed. If required, an auxiliary motor 22' at the drilling head 21 may be hooked up in order to increase the effective torque, e.g. to double the normal momentum. This feature is most useful both in thread breaking or unscrewing and, sometimes, during drilling.

From the sectional view of FIG. 20, the lower half of the spindle proper 52 and its profile can be seen. There is an inlet 64 for a flushing fluid. Farther below, a spindle guide bush 65 is mounted that abuts the profiled inset 51.

Figures 16A, 16B, 16C, 17A, 17B, 17C, 18A, 18B, 18C:
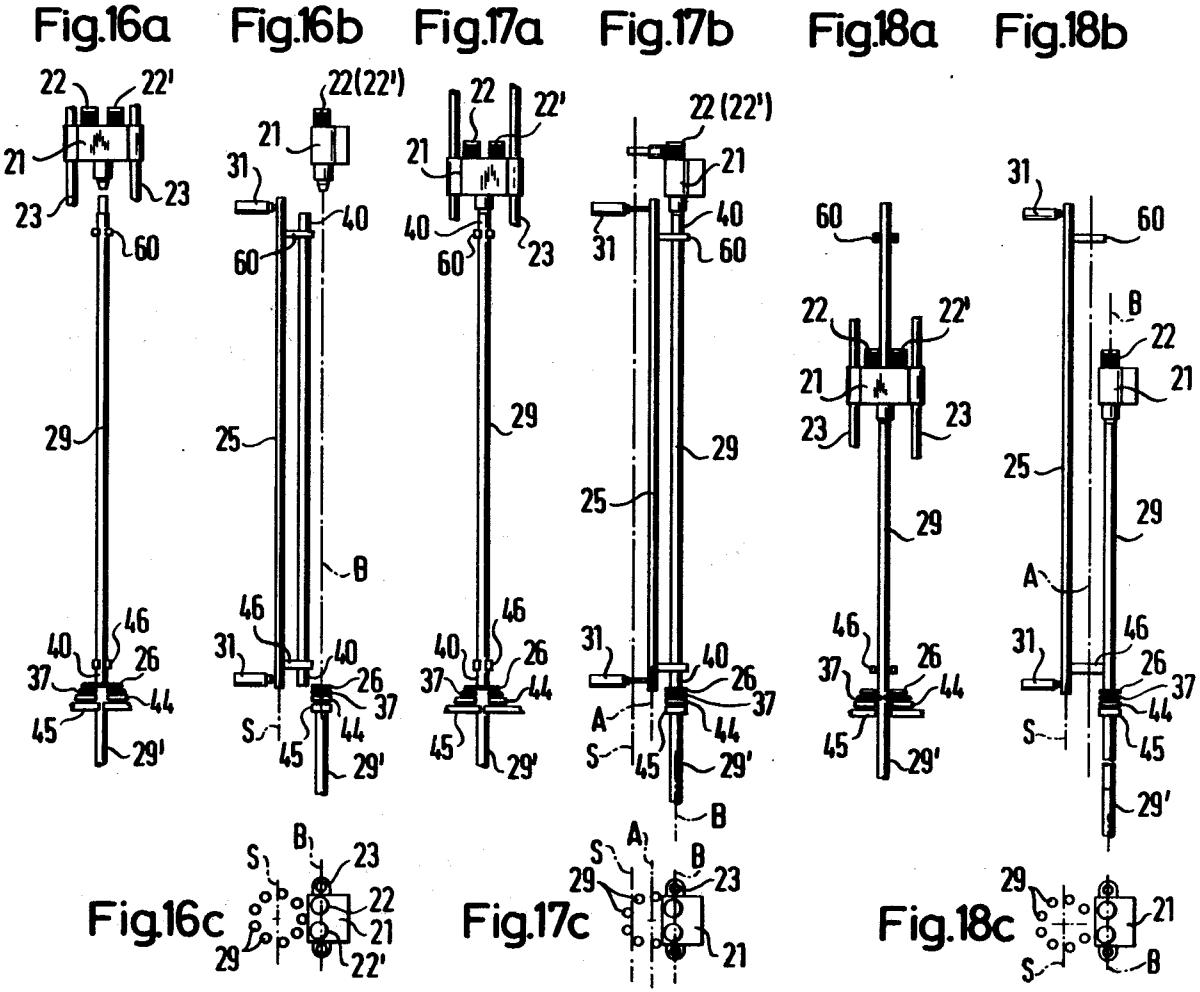

As will become evident from FIGS. 16 to 18 including the various views *a* to *c*, the drilling apparatus according to the invention is employed in the following way. While the drilling head 21 is in its top position, one of the drill rods 29 is picked up by the clasped jaws 60 and/or the grapplers 46 and then moved by the transverse drive 31 engaging the rack 24 from the storage position S (FIGS. 16*a* to 16*c*) into the drilling position (FIGS. 17*a* to 17*c*) until alignment with the drilling center B is reached. Then the drilling head 21 is lowered in its slide track 23 and its cone thread 53 is screwed onto the outer end 40 of the drill rod 29 by means of motor 22. Thereafter, the upper clasp jaw 60 is released and the drilling head 21 is further descended, e.g. by about 4 to 6 inches, until the drill rod 29 plunges into the closed centering block 37. Upon opening of the (lower) grappler 46, the rack 24 is retracted and the drill rod 29 may be screwed onto a lower drill rod 29' already situated in the drilling hole and retained against rotation by the device 45. When the latter is released and the drilling head 21 is descended, motor 22 may run to continue the drilling operation at the tower 14 as shown in FIGS. 18*a* to 18*c* until the upper drill rod end 40 is in the position indicated by 29' in FIGS. 16*a* and 16*b*, whereupon the cycle described may be repeated.

The operation is reversed for shortening the drill string by moving the drilling head 21 whose cone thread 53 is screwed onto the topmost drill rod 29 from an intermediate position (FIGS. 18*a* and 18*b*) to an upper stop (not shown) so that the lower end of drill rod 29 is still retained in the brackets 44 but released from the (lower) retaining device 45. By closing the lower retaining device 45, the adjacent drill rod 29' is clamped to engage the upper or outer end 40. It is now possible to have the motor 22 run in opposite direction in order to break the thread connection between the two rods 29 and 29'. If this can be done at the first attempt, rack 24 is extended by the transverse drives 31 and the grapplers 46 as well as the clasp jaws 60 take hold of the drill rod 29 to be removed. Storing is effected by putting the drill rod 29 on the table rest 26, loosening the upper thread connection at the drilling head 21 and homing the rod in the storage position S (16*a* to 16*c*).

It may happen, if rarely, that the thread connection is loosened at the drilling head 21 rather than at the lower end. Then the arrangement according to FIGS. 7 and 19 is used for rescrewing the drill string to the drilling head 21 with extended spindle proper 52 and motor 22 running forward. Then drill rod 29 is very slowly rotated while the spindle proper 52 is cautiously retracted so as to pull the matching profile 41 of outer drill rod end 40 into the profiled inset 51 of outer drill spindle 50. Thereupon the spindle proper 52 may be fully retracted by discharging the pressure chamber 57, the outer end 40 then being firmly held by outer drill spindle 50. Consequently, only the lower thread connection may break when motor 22 is reversed. The unscrewed drill rod 29 will then be put onto the table rest 26 extended together with rack 24, whereupon spindle proper 52 is descended and cone thread 53 is unscrewed. Then the drill rod 29 may be stored in position S as explained above. It will be noted that the special profile of outer ends 40 (FIGS. 8 and 9) as well as of outer drill spindle 50 and inset 51 permits breaking the rod thread connection most effectively even in otherwise discouraging cases. Here, too, the second or auxiliary motor 22' may be employed.

The invention is not limited to the examples given. Thus it is possible to design the drilling apparatus according to the invention for use with high-pressure engines and rotary drill hammers in connection with pneumatic motors. As compared to conventional apparatus such as employed in quarries, it is possible to economize in a large degree through the use of hydraulic drives and controls for the advancing and screwing operations of the drilling motor, for dust removal, etc. A substantial advantage of the invention results in the fact that handling and maintenance of the drilling apparatus is much facilitated as opposed to the prior art and that an unusually high drilling performance is achieved despite working expenses amounting to about one half only of the operating cost incurred with conventional equipment. For instance, when drilling through basalt using a Flottmann DC 105 H hammer under a pressure of 190 psi, a net drilling performance of 24 meters per hour (22 yards/hour) could be obtained without trouble. Moreover, by revolving the rack 24, drill rod removal and storage can be effected within a few minutes since the stepper 33 warrants the correct angular position for any such operation.

While the principles of the invention have been described above by explaining specific examples, it is to be clearly understood that this description may not be construed as a limitation to the scope of the invention as set forth in the objects thereof and in the accompanying claims.

What is claimed is:

1. A drilling apparatus comprising:

a. a mobile base support structure, b. a drilling tower supported on said support structure, c. a bearing means upon which said tower is mounted on a horizontal axis, said bearing means permitting adjustment of said drilling tower in a transverse direction relative to said horizontal axis, d. a drilling head mounted on said drilling tower so that the drilling head can move along the length of said drilling tower, e. rotary driving means for a drill rod mounted on said drilling head, f. a storage means included in said drilling tower for receiving a plurality of drill rods in a parallel arrangement of rotational symmetry, said drill rods having cone thread ends for the formation of a drill string and being adapted to be singly handled, said storage means including 1. a revolving rack means which is mounted centrally with respect to said drilling tower, and 2. means for rotating said rack means in arcuate increments so as to permit both the transfer of drill rods out of said rack means and into said rack means, and g. nesting means associated with said revolving rack, said nesting means including grapplers having spreader arms and transverse drive means, said spreader arms and transverse drive means being adapted to cooperate to transfer drill rods into and out of said rack.

2. Drilling apparatus according to claim 1 wherein said nesting means include seats arranged at the circumference thereof, said revolving rack comprising at its lower side an aperture for singly receiving and removing said drill rods in and out of said seats.

3. Drilling apparatus according to claim 1 including retainer means arranged at either end of said drilling tower and provided with profile projections for locking the outer ends of a drill rod situated in the center of the drilling apparatus, the outer ends of said profile projections having matching profile recesses, said grapplers having an inside profile adapted to positively lock said matching profile at the outer end of each rod.

4. Drilling apparatus according to claim 1 which includes a transverse drive means wherein said revolving rack means is adapted to be shifted by said transverse drive means to and from the drilling center line.

5. Drilling apparatus according to claim 1 wherein a sub-tower is tiltably mounted on said mobile-base support structure and wherein said bearing means is attached substantially to the center of said support structure and comprises a bearing means pivotaly securing said tower to said sub-tower.

6. A drilling apparatus according to claim 5 wherein said tower comprises a flat-sided framework, one side of which includes a slide track for said drilling head, said framework being slightly displaced towards one side of said support structure and a drilling head slide track on the opposite side of said framework.

7. A drilling apparatus comprising a. a mobile base support structure, b. a drilling tower supported on said support structure, c. a bearing means upon which said tower is mounted on a horizontal axis, said bearing means permitting adjustment of said drilling tower in a transverse direction relative to said horizontal axis, d. a drilling head mounted on said drilling tower so that the drilling head can move along the length of said drilling tower, e. rotary driving means for a drill rod mounted on said drilling head, f. a storage means included in said drilling tower for receiving a plurality of drill rods in a parallel arrangement of rotational symmetry, said drill rods having cone thread ends for the formation of a drill string and being adapted to be singly handled, said storage means including 1. a revolving rack means which is mounted centrally with respect to said drilling tower, and 2. means for rotating said rack means in arcuate increments so as to permit both the transfer of drill rods out of said rack means and into said rack means, and g. stanchions having universal joint shoes that are arranged on said mobile base support structure for downward extension in order to prop up the latter, and a further joint shoe on the foot of said tower.

8. A drilling apparatus comprising:

a. a mobile base support structure, b. a drilling tower supported on said support structure, c. a bearing means upon which said tower is mounted on a horizontal axis, said bearing means permitting adjustment of said drilling tower in a transverse direction relative to said horizontal axis, d. a drilling head mounted on said drilling tower so that the drilling head can move along the length of said drilling tower, e. rotary driving means for a drill rod mounted on said drilling head, f. a storage means included in said drilling tower for receiving a plurality of drill rods in a parallel arrangement of rotational symmetry, said drill rods having cone thread ends for the formation of a drill string and being adapted to be singly handled, said storage means including 1. a revolving rack means which is mounted centrally with respect to said drilling tower, and 2. means for rotating said rack means in arcuate increments so as to permit both the transfer of drill rods out of said rack means and into said rack means, and g. retainer means arranged at either end of said tower and provided with profile projections for locking the outer ends of a drill rod situated in the drilling center line, said outer ends having matching profile recesses and a fluid actuated hammer drill having an outer profile identical to said matching profile of each outer drill rod end.

9. A drilling apparatus comprising:

a. a mobile base support structure, b. a drilling tower supported on said support structure, said tower being mounted on a horizontal axis, c. a drilling head mounted on said drilling tower so that the drilling head can move along the length of said drilling tower, d. rotary driving means for a drill rod mounted on said drilling head, e. a storage means included in said drilling tower for receiving a plurality of drill rods in a parallel arrangement of rotational symmetry, f. a plurality of drill rods, each of said drill rods 1. having cone thread ends for the formation of a drill string and being adapted to be singly handled, 2. being provided with a circumferential groove at its upper end, g. a drill rod centering means having disengageable jaws arranged at the foot of the drilling tower, said jaws having an inside profile adapated to positively lock in said circumferential groove at the upper end of each drill rod.

10. A drilling apparatus comprising a. a mobile base support structure, b. a drilling tower supported on said support structure, said tower being mounted on a horizontal axis, c. a drilling head mounted on said drilling tower so that the drilling head can move along the length of said drilling tower, d. rotary driving means for a drill rod mounted on said drilling head, e. a storage means included in said drilling tower for receiving a plurality of drill rods in a parallel arrangement of rotational symmetry, f. a plurality of drill rods, each of said drill rods 1. having cone thread ends for the formation of a drill string and being adapted to be singly handled, 2. being provided with a circumferential groove at its upper end, g. a centering table having disengageable jaws, said jaws having an inside profile adapted to positively lock in said circumferential groove at the upper end of each drill rod.

11. A drilling apparatus comprising a. a mobile base support structure, b. a drilling tower supported on said support structure, said tower being mounted on a horizontal axis, c. a drilling head mounted on said drilling tower so that the drilling head can move along the length of said drilling tower, d. rotary driving means for a drill rod mounted on said drilling head, e. a storage means included in said drilling tower for receiving a plurality of drill rods in a parallel arrangement of rotational symmetry, said drill rods having cone thread ends for the formation of a drill string and being adapted to be singly handled, said storage means including a revolving rack means which is mounted centrally with respect to said drilling tower, said revolving rack means including a rod securing device with jaw means having an inside profile adapted to positively lock in a circumferential groove at the upper end of each drill rod.

12. A drilling apparatus comprising a. a mobile base support structure, b. a drilling tower supported on said support structure, said tower being mounted on a horizontal axis, c. a drilling head mounted on said drilling tower so that the drilling head can move along the length of said drilling tower, d. rotary driving means for a drill rod mounted on said drilling head, e. a storage means included in said drilling tower for receiving a plurality of drill rods in a parallel arrangement of rotational symmetry, f. a plurality of drill rods, each of said drill rods 1. having cone thread ends for the formation of a drill string and being adapted to be singly handled, 2. being provided with a recess profile at its outer end, g. said drilling head comprising an outer drill spindle carrying at its lower end a profiled inset matching said outer drill rod ends, and a spindle proper coaxially mounted inside said outer drill spindle for rotation therewith, said spindle proper having at its lower end a cone thread for engaging the respective cone thread of the topmost drill rod of the drill string.

13. Drilling apparatus according to claim 12 wherein said spindle proper is hollow and includes at its upper end a fitting for connection of a flushing means thereto.

* * * * *